US010053837B2

(12) United States Patent
Doi et al.

(10) Patent No.: US 10,053,837 B2
(45) Date of Patent: Aug. 21, 2018

(54) SLEWING CONTROL DEVICE FOR HYBRID CONSTRUCTION MACHINE AND HYBRID CONSTRUCTION MACHINE

(71) Applicant: KOBELCO CONSTRUCTION MACHINERY CO., LTD., Hiroshima-shi (JP)

(72) Inventors: Takayuki Doi, Hiroshima (JP); Kazushige Koiwai, Hiroshima (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 37 days.

(21) Appl. No.: 15/271,865

(22) Filed: Sep. 21, 2016

(65) Prior Publication Data

US 2017/0096796 A1 Apr. 6, 2017

(30) Foreign Application Priority Data

Oct. 2, 2015 (JP) ..... 2015-196367

(51) Int. Cl.
*E02F 9/12* (2006.01)
*E02F 9/20* (2006.01)
*E02F 3/32* (2006.01)

(52) U.S. Cl.
CPC ..... *E02F 9/123* (2013.01); *E02F 3/32* (2013.01); *E02F 9/2075* (2013.01)

(58) Field of Classification Search
CPC ..... E02F 9/123; E02F 9/2075; E02F 3/32
See application file for complete search history.

(56) References Cited

U.S. PATENT DOCUMENTS 6,266,594 B1 * 7/2001 Ishikawa ..... B60G 17/005 177/1
6,959,234 B2 * 10/2005 Vos ..... B60C 23/061 340/444
7,395,142 B2 * 7/2008 Mori ..... B60K 28/14 180/443

(Continued)

FOREIGN PATENT DOCUMENTS

EP 2 366 837 A2 9/2011
EP 2 366 837 A3 9/2011

(Continued)

OTHER PUBLICATIONS

Extended European Search Report dated Feb. 13, 2017 in Patent Application No. 16188893.8.

*Primary Examiner* — Frederick M Brushaber
(74) *Attorney, Agent, or Firm* — Oblon, McClelland, Maier & Neustadt, L.L.P.

(57) ABSTRACT

A brake control unit operates a mechanical brake when a slewing operation amount detected by a slewing operation amount detection unit indicates slewing stop and when a slewing speed detected by a slewing speed detection unit is equal to or lower than a predetermined speed. A time measurement unit measures a brake operation time period during which a brake operation detection value detected by a brake operation detection unit exceeds a predetermined threshold. When the mechanical brake is operated and when the brake operation time period measured by the time measurement unit exceeds a predetermined reference time period, a slewing control unit stops outputting a slewing command.

5 Claims, 7 Drawing Sheets

(56) References Cited

U.S. PATENT DOCUMENTS

| | | | | |
|---|---|---|---|---|
| 7,482,914 | B2 * | 1/2009 | Inoue | B60K 35/00 340/438 |
| 7,706,947 | B2 * | 4/2010 | Bozem | B66F 17/003 177/45 |
| 7,795,547 | B2 * | 9/2010 | Hansen | G01G 19/083 177/1 |
| 8,214,101 | B2 * | 7/2012 | Carlton | G01M 15/042 340/438 |
| 8,538,670 | B2 * | 9/2013 | Lanzl | E21B 7/005 340/685 |
| 2005/0253542 | A1 | 11/2005 | Sugano et al. | |
| 2011/0227512 | A1 * | 9/2011 | Komiyama | B66C 23/86 318/369 |
| 2013/0243557 | A1 * | 9/2013 | Hiroki | B60L 11/123 414/687 |
| 2014/0145657 | A1 | 5/2014 | Takeo | |
| 2014/0190159 | A1 * | 7/2014 | Tajima | E02F 9/128 60/466 |
| 2015/0275478 | A1 | 10/2015 | Yanagisawa | |

FOREIGN PATENT DOCUMENTS

| | | |
|---|---|---|
| EP | 2 743 409 A1 | 6/2014 |
| JP | 3977697 | 9/2007 |

* cited by examiner

SLEWING CONTROL DEVICE FOR HYBRID CONSTRUCTION MACHINE AND HYBRID CONSTRUCTION MACHINE

BACKGROUND OF THE INVENTION AND RELATED ART STATEMENT

Field of the Invention

The present invention relates to a slewing control device for a hybrid construction machine, and a hybrid construction machine provided with the slewing control device.

Description of the Related Art

In recent years, slewing construction machines such as shovels and cranes are configured such that, in order to reliably stop and hold a slewing superstructure, a mechanical brake as well as position holding control for holding the slewing superstructure in a current position is used to stop and hold the slewing superstructure.

Japanese Patent No. 3977697 discloses the following technology. Specifically, as illustrated in FIG. 4 of Japanese Patent No. 3977697, when an operation lever is operated to the center side with respect to positions LnL and LnR, position holding control for holding a slewing superstructure in a current position is started based on a signal from a position sensor. Then, in Japanese Patent No. 3977697, when the operation lever is operated to the center side with respect to positions LbL and LbR (positions closer to the center than the positions LnL and LnR), the operation of a mechanical brake is started. Then, in Japanese Patent No. 3977697, when the operation lever is operated to the center side with respect to positions LzL and LzR (positions closer to the center than the positions LbL and LbR), the position holding control is finished.

In Japanese Patent No. 3977697, although the position holding control is finished at the positions LzL and LzR, the position holding control is finished without having determined whether or not a braking force of the mechanical brake is sufficiently effective. Therefore, in Japanese Patent No. 3977697, if the braking force of the mechanical brake is insufficient when the operation lever reaches the position LzL or LzR, the slewing superstructure may move in a slewing direction due to the action of the gravitational force, that is, so-called "slewing-down movement" may occur. In particular, when the construction machine is located on an inclined ground, the gravitational force applied to the slewing superstructure in the direction to slew the slewing superstructure is increased to increase the possibility of the occurrence of slewing-down movement.

SUMMARY OF INVENTION

It is an object of the present invention to provide a slewing control device for a hybrid construction machine, which prevents slewing-down movement, and a construction machine including the braking control device.

A slewing control device for a hybrid construction machine according to one aspect of the present invention includes:

a slewing motor configured to slew a slewing superstructure;

a slewing operation amount detection unit configured to detect a slewing operation amount of the slewing superstructure;

a slewing control unit configured to output a slewing command for operating the slewing superstructure at a slewing speed corresponding to the slewing operation amount, thereby controlling the slewing motor;

a slewing speed detection unit configured to detect a slewing speed of the slewing superstructure;

a mechanical brake configured to mechanically stop and hold the slewing superstructure;

a brake control unit configured to, when the slewing operation amount indicates slewing stop, avoid operating the mechanical brake until the detected slewing speed is equal to or lower than a predetermined speed, and operate the mechanical brake after the detected slewing speed is equal to or lower than the predetermined speed;

a brake operation detection unit configured to detect a brake operation detection value representing a braking force of the mechanical brake; and a time measurement unit configured to measure a time period during which the detected brake operation detection value exceeds a predetermined threshold, in which, when the mechanical brake is operated, the slewing control unit outputs the slewing command until the time period measured by the time measurement unit exceeds a predetermined reference time period, and stops outputting the slewing command after the measured time period exceeds the predetermined reference time period.

This configuration can prevent slewing-down movement.

Further, a hybrid construction machine according to one aspect of the present invention includes: a slewing superstructure; and the braking control device for a hybrid construction machine.

This configuration can provide a hybrid construction machine capable of preventing slewing-down movement.

DETAILED DESCRIPTION OF THE PREFERRED EMBODIMENTS OF THE INVENTION

Referring to the accompanying drawings, exemplary embodiments of the present invention are now described. The following embodiments are examples embodying the present invention, and are not intended to limit the technical scope of the present invention.

Embodiment 1

Figure 1:
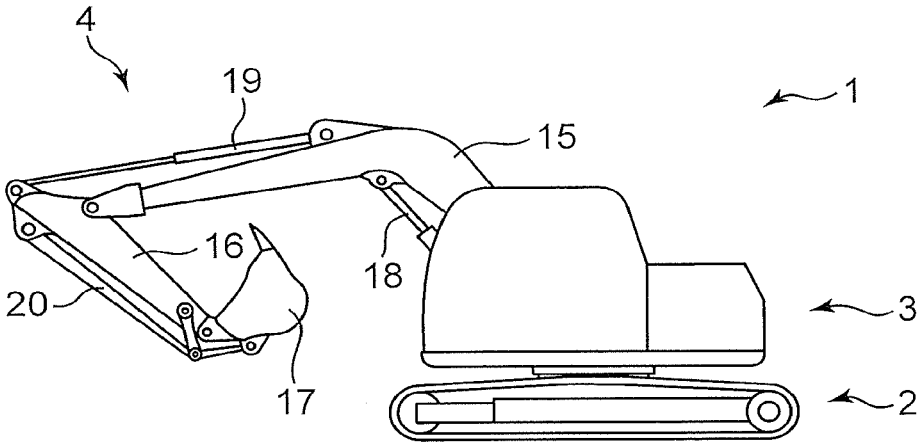
FIG. 1 is an outline view of a hybrid shovel 1 in a case where a hybrid construction machine is applied to the hybrid shovel 1 according to Embodiment 1 of the present invention.

FIG. 1 is an outline view of a hybrid shovel 1 in a case where a hybrid construction machine is applied to the hybrid shovel 1 according to Embodiment 1 of the present invention. The hybrid shovel 1 includes a crawler undercarriage 2, a slewing superstructure 3 slewably provided on the undercarriage 2, and a work attachment 4 attached to the slewing superstructure 3.

The work attachment 4 includes a boom 15 hoistably attached to the slewing superstructure 3, an a m 16 swingably attached to a distal end portion of the boom 15, and a bucket 17 swingably attached to a distal end portion of the arm 16.

The work attachment 4 further includes a boom cylinder 18 configured to hoist the boom 15 with respect to the slewing superstructure 3, an arm cylinder 19 configured to swing the arm 16 with respect to the boom 15, and a bucket cylinder 20 configured to swing the bucket 17 with respect to the arm 16.

Figure 2:
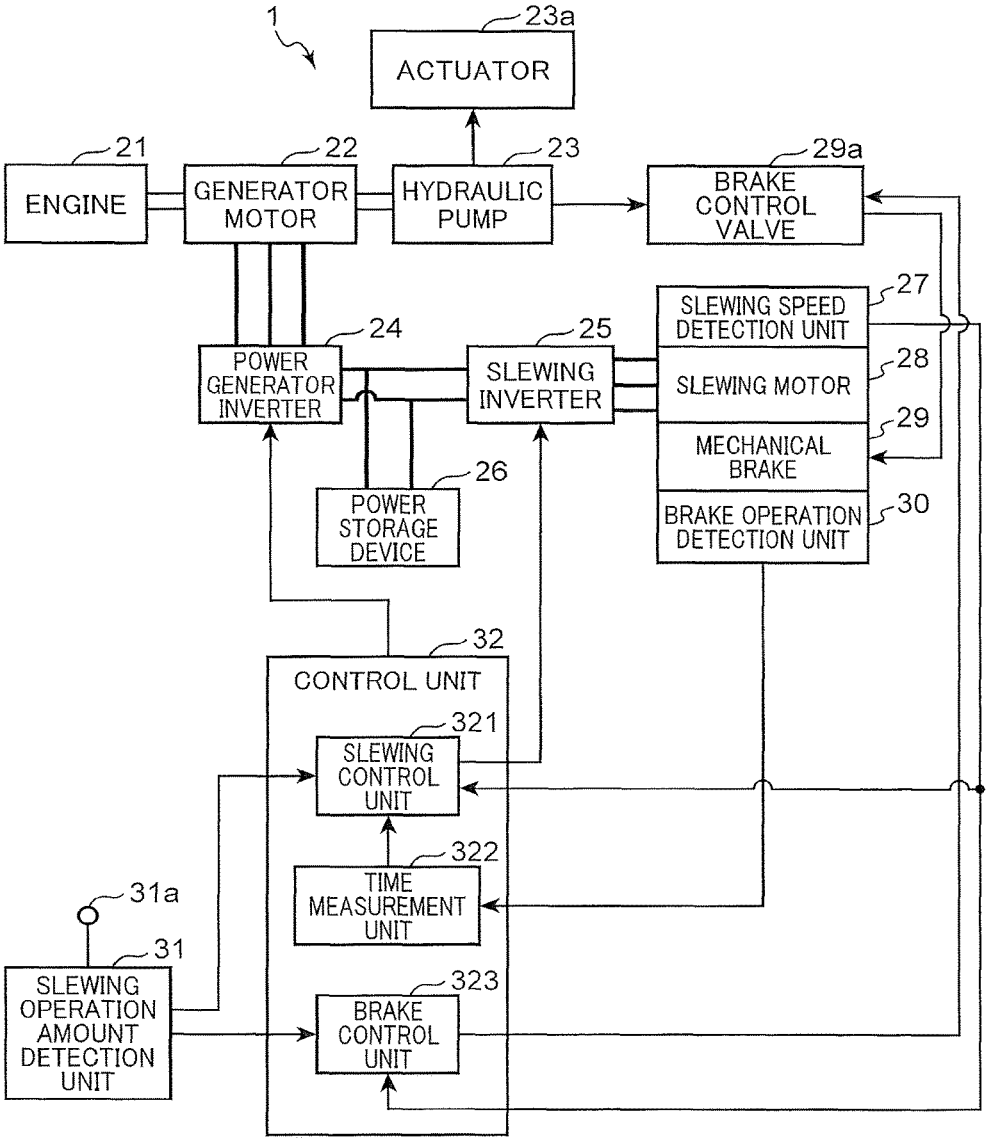
FIG. 2 is a block diagram illustrating an exemplary system configuration of the hybrid shovel 1 according to Embodiment 1 of the present invention.

FIG. 2 is a block diagram illustrating an exemplary system configuration of the hybrid shovel 1 according to Embodiment 1 of the present invention.

The hybrid shovel 1 includes an engine 21, a hydraulic pump 23 and a generator motor 22 that are coupled to an output shaft of the engine 21, and a power generator inverter 24 configured to control charge and discharge of a power storage device 26 and drive of the generator motor 22. The hybrid shovel 1 further includes a slewing inverter 25 configured to control the charge and discharge of the power storage device 26 and drive of a slewing motor 28, and the slewing motor 28 to be driven by the slewing inverter 25. The hybrid shovel 1 further includes the power storage device 26 that can be charged with electric power generated by the generator motor 22 and a control unit 32 configured to control the power generator inverter 24 and the slewing inverter 25. Note that, in FIG. 2, the thick lines indicate power lines, the thin lines indicate control flows, and the double lines indicate the output shaft of the engine 21.

The engine 21 is, for example, a diesel engine.

The generator motor 22 is, for example, a three-phase motor, and functions as a generator with driving power from the engine 21. The generator motor 22 further functions as a motor with electric power from the power storage device 26 to assist the engine 21.

The hydraulic pump 23 is driven by the driving power of the engine 21 to eject drive oil. The drive oil ejected from the hydraulic pump 23 is introduced to a plurality of hydraulic actuators 23*a* including the cylinders 18 to 20 (see FIG. 1) via a control valve (not shown). The drive oil ejected from the hydraulic pump 23 is further introduced to a mechanical brake 29 via a brake control valve 29*a*.

The power generator inverter 24 is, for example, a three-phase inverter, and controls switching between the function of the generator motor 22 as a generator and the function of the generator motor 22 as a motor under control of the control unit 32. The power generator inverter 24 further controls torque of the generator motor 22.

The slewing inverter 25 is, for example, a three-phase inverter, and supplies the electric power of the power storage device 26 to the slewing motor 28 to drive the slewing motor 28. The slewing inverter 25 further accumulates, in the power storage device 26, regenerative power generated in the slewing motor 28 during slewing deceleration of the slewing superstructure 3. The slewing inverter 25 further controls torque of the slewing motor 28.

The power storage device 26 is, for example, a secondary battery such as a lithium ion battery, a nickel hydrogen battery, and an electric double layer capacitor, and accumulates therein the electric power generated by the generator motor 22 under control of the power generator inverter 24. The power storage device 26 further accumulates therein the regenerative power of the slewing motor 28 under control of the slewing inverter 25.

A slewing speed detection unit 27 is, for example, a speed sensor mounted to the slewing motor 28, and detects a slewing speed of the slewing superstructure 3.

The slewing motor 28 is, for example, a three-phase motor, and is driven with the electric power of the power storage device 26 to slew the slewing superstructure 3 illustrated in FIG. 1.

The mechanical brake 29 operates with the drive oil supplied thereto from the hydraulic pump 23 via the brake control valve 29*a*, and brakes the slewing motor 28 to mechanically stop and hold the slewing superstructure 3. Specifically, the mechanical brake 29 is a negative brake, which includes a cylinder (not shown) and a spring (not shown) and is configured to release a braking force to the slewing motor 28 when a hydraulic pressure is introduced from the brake control valve 29*a* to the cylinder and apply the braking force to the slewing motor 28 with the force of the spring when the introduction of the hydraulic pressure from the brake control valve 29*a* to the cylinder is released.

The brake control valve 29*a* is a solenoid on-off valve that operates in response to a control signal from a brake control unit 323. When a control signal for brake release is input to the brake control valve 29*a*, the brake control valve 29*a* introduces the hydraulic pressure to the cylinder. When a control signal for brake operation is input to the brake control valve 29*a*, the brake control valve 29*a* releases the introduction of the hydraulic pressure to the cylinder.

A brake operation detection unit 30 detects a brake operation detection value representing a braking force of the mechanical brake 29. In Embodiment 1, the brake operation detection unit 30 is, for example, a hydraulic sensor, and detects the hydraulic pressure of the mechanical brake 29 as the brake operation detection value.

A slewing operation amount detection unit 31 detects, for example, an inclination angle of a slewing lever 31*a* as a slewing operation amount, and outputs the slewing operation amount to a slewing control unit 321 and the brake control unit 323. For the slewing operation amount, a neutral point is set in advance at a position at which the inclination angle of the slewing lever 31*a* is zero, and a neutral range is set in advance in a range with a predetermined width in the right and left direction from the neutral point (for example, an inclination angle of the slewing lever 31*a* of 7.5 degrees each to the right and left). The relation between the slewing operation amount and a target speed of the slewing superstructure 3 is determined in advance so that, when the slewing lever 31*a* is inclined beyond the neutral range, the target speed increases as the inclination angle of the slewing lever 31*a* increases.

The control unit 32 is configured by, for example, a processor such as an application specific integrated circuit (ASIC), a field-programmable gate array (FPGA), and a CPU, a ROM, a RAM, and a rewritable storage device such as an EEPROM. The control unit 32 controls the entire hybrid shovel 1.

In Embodiment 1, the control unit 32 particularly includes the slewing control unit 321, a time measurement unit 322, and the brake control unit 323. The slewing control unit 321 to the brake control unit 323 may be implemented by a CPU executing a control program, or may be implemented by dedicated hardware circuits.

The slewing control unit 321 outputs, to the slewing inverter 25, a slewing command for operating the slewing superstructure 3 at a target speed corresponding to the slewing operation amount detected by the slewing operation amount detection unit 31, thereby controlling the slewing motor 28. In this case, when the slewing speed detected by the slewing speed detection unit 27 is lower than the target speed, the slewing control unit 321 outputs a slewing command for increasing the slewing speed to the slewing inverter 25. When the slewing speed detected by the slewing speed detection unit 27 is higher than the target speed, on the other hand, the slewing control unit 321 outputs a slewing command for decreasing the slewing speed to the slewing inverter 25.

When the slewing lever 31*a* is positioned in the neutral range, the slewing control unit 321 outputs a slewing command for controlling the slewing speed to be zero to the slewing inverter 25. In this manner, zero-speed control for maintaining the slewing speed of the slewing superstructure 3 to be zero is implemented.

When the slewing operation amount detected by the slewing operation amount detection unit 31 indicates slewing stop and when the slewing speed detected by the slewing speed detection unit 27 is equal to or lower than a predetermined speed, the brake control unit 323 outputs a control signal for brake operation to the brake control valve 29*a*, thereby operating the mechanical brake 29. Even when the slewing operation amount detected by the slewing operation amount detection unit 31 indicates slewing stop, the brake control unit 323 outputs a control signal for brake release to the brake control valve 29*a* until the slewing speed detected by the slewing speed detection unit 27 is equal to or lower than the predetermined speed, thereby avoiding operating the mechanical brake 29.

As the slewing operation amount indicating slewing stop, the inclination angle of the slewing lever 31*a* at which the slewing lever 31*a* is positioned in the neutral range can be employed.

The time measurement unit 322 measures a brake operation time period during which the brake operation detection value detected by the brake operation detection unit 30 exceeds a predetermined threshold. The mechanical brake 29 employs a negative brake as described above. Accordingly, the state where "the brake operation detection value exceeds a threshold" corresponds to the state where the hydraulic pressure, which is the brake operation detection value, is equal to or lower than a threshold so that a braking force is applied to the slewing motor 28. This is, however, an example. When the mechanical brake 29 employs a positive brake, the state where "the brake operation detection value exceeds a threshold" corresponds to the state where the hydraulic pressure, which is the brake operation detection value, is equal to or higher than a threshold. Examples of the threshold that can be employed include a predetermined value of the hydraulic pressure indicating that the braking force of the mechanical brake 29 starts to be effective.

The slewing control unit 321 stops outputting the slewing command when the mechanical brake 29 is operated and when the brake operation time period measured by the time measurement unit 322 exceeds a predetermined reference time period. On the other hand, the slewing control unit 321 outputs the slewing command until the measured brake operation time period exceeds the reference time period when the mechanical brake 29 is operated. An example of the reference time period that can be employed here is a predetermined time period, the elapse of which from the start of the operation of the mechanical brake 29 indicates that the brake is sufficiently effective.

Figure 3:
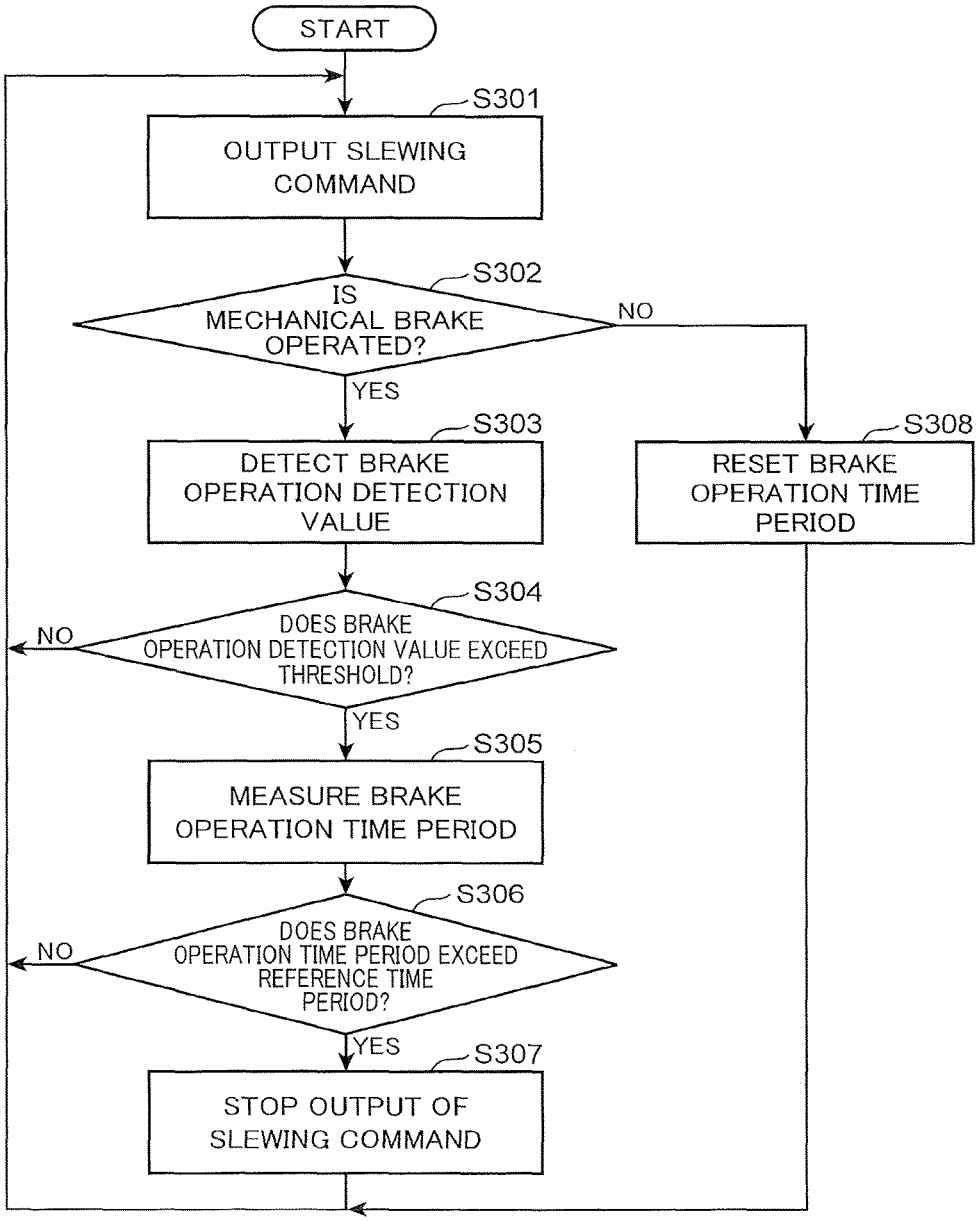
FIG. 3 is a flowchart illustrating operation of the hybrid shovel 1 according to Embodiment 1 of the present invention.

FIG. 3 is a flowchart illustrating the operation of the hybrid shovel 1 according to Embodiment 1 of the present invention.

First, the slewing control unit 321 outputs, to the slewing inverter 25, a slewing command for controlling the slewing speed detected by the slewing speed detection unit 27 to be a target speed corresponding to the slewing operation amount detected by the slewing operation amount detection unit 31 (S301). In this case, when the slewing operation amount indicates slewing stop, the slewing control unit 321 outputs a slewing command for controlling the target speed to be zero to the slewing inverter 25. In this manner, zero-speed control by the slewing control unit 321 is started.

Next, when the slewing operation amount indicates slewing stop and when the slewing speed detected by the slewing speed detection unit 27 is equal to or lower than a predetermined speed, the brake control unit 323 outputs a control signal for brake operation to the brake control valve 29*a*, thereby operating the mechanical brake 29 (YES in S302). When the slewing operation amount does not indicate slewing stop or when the slewing speed detected by the slewing speed detection unit 27 is not equal to or lower than the predetermined speed, on the other hand, the brake control unit 323 outputs a control signal for brake release to the brake control valve 29*a*, thereby avoiding operating the mechanical brake (NO in S302). When NO is determined in S302, the processing proceeds to S308. The mechanical brake 29 is not operated unless the slewing speed is equal to or lower than the predetermined speed, and hence wear of the mechanical brake 29 is suppressed. Accordingly, the predetermined speed that can be employed is a predetermined speed indicating that the slewing speed is decreased to the degree that the wear of the mechanical brake 29 can be suppressed.

In S303, the brake operation detection unit 30 detects a brake operation detection value.

When the brake operation detection value exceeds a threshold (YES in S304), the time measurement unit 322 measures a brake operation time period (S305). When the brake operation detection value does not exceed the threshold (NO in S304), the processing is returned to S301. In other words, the measurement of the brake operation time period is started after waiting for the brake operation detection value to exceed the threshold.

Next, when the brake operation time period exceeds a reference time period (YES in S306), the slewing control unit 321 stops outputting the stewing command to the slewing inverter 25 (S307). In this manner, the zero-speed control is turned off. When the brake operation time period does not exceed the reference time period (NO in S306), on the other hand, the processing is returned to S301.

In S308, the time measurement unit 322 resets the brake operation time period.

As described above, in Embodiment 1, after waiting for the brake operation time period to exceed the reference time period (YES in S306), the output of the slewing command is stopped (S307). Consequently, in Embodiment 1, the zero-speed control can be finished after it is confirmed that the braking force of the mechanical brake 29 has been sufficiently effective, and hence slewing-down movement can be prevented.

A hydraulic circuit has an operation delay. Even when the brake control unit 323 outputs a control signal for brake operation, the pressure of the drive oil does not immediately reach a pressure necessary for the operation of the mechanical brake 29. Thus, in order to determine whether or not the pressure of the drive oil has reached a pressure necessary for the operation of the mechanical brake 29, the pressure of the drive oil needs to be monitored after the brake control unit 323 outputs the control signal to the brake control valve 29*a*. To address this, in Embodiment 1, the brake operation detection value is detected, and it is determined whether or not the brake operation detection value exceeds a threshold.

However, the mechanical brake 29 has a mechanical delay. Even when the brake operation detection value exceeds a threshold, a given time period is required for the mechanical brake 29 to actually stop the slewing motor 28 after the brake operation detection value exceeded the threshold. To address this, in Embodiment 1, the zero-speed control is turned off after waiting for the brake operation time period exceeds the reference time period.

Consequently, in Embodiment 1, the zero-speed control can be finished after it is confirmed that the braking force of the mechanical brake 29 has been sufficiently effective, and hence the slewing-down movement can be prevented.

Embodiment 2

A hybrid shovel 1 in Embodiment 2 has a feature in that the reference time period is determined based on an inclination angle of the hybrid shovel 1. In Embodiment 2, the same components as those in Embodiment 1 are denoted by the same reference symbols and descriptions thereof are omitted.

Figure 4:
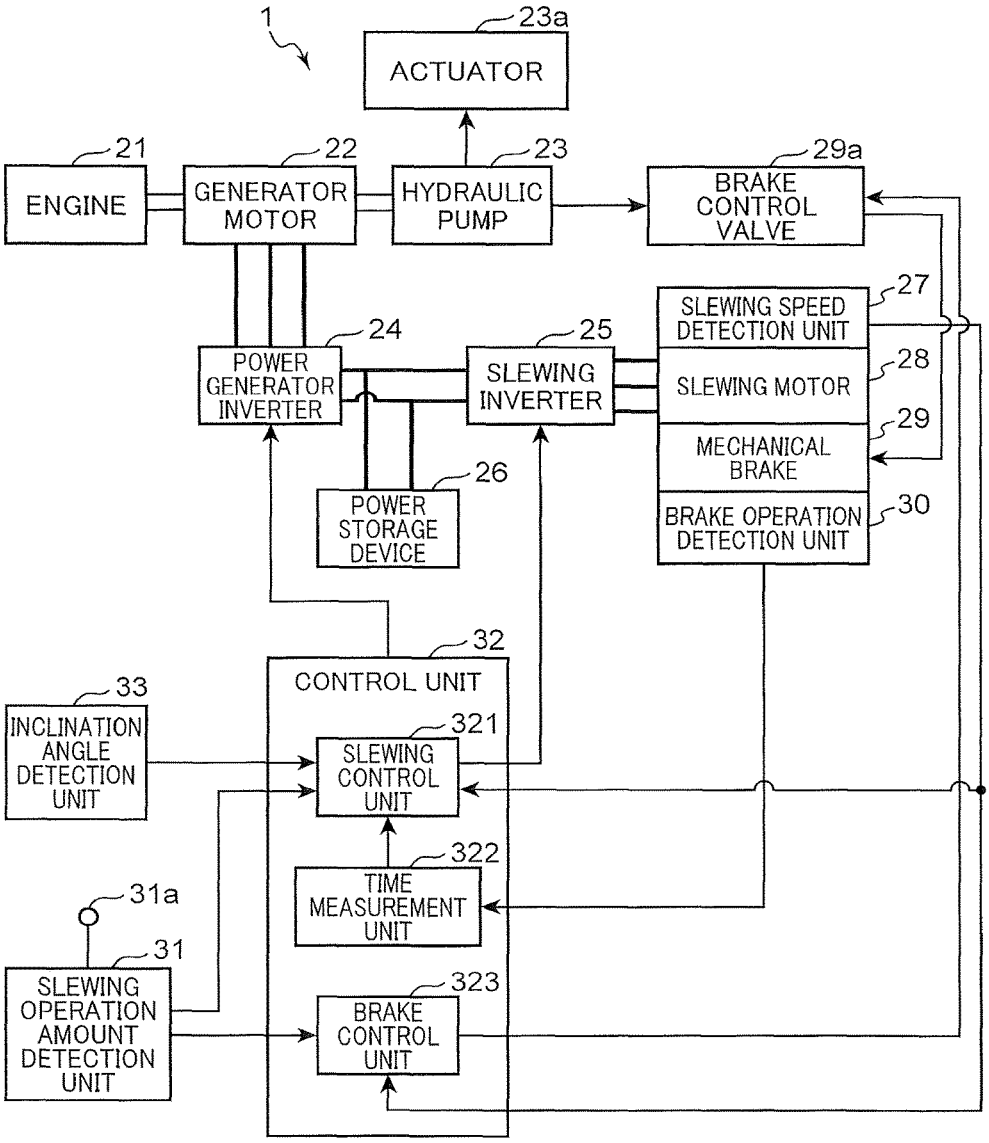
FIG. 4 is a block diagram illustrating an exemplary system configuration of a hybrid shovel 1 according to Embodiment 2 of the present invention.

FIG. 4 is a block diagram illustrating an exemplary system configuration of the hybrid shovel 1 according to Embodiment 2 of the present invention. FIG. 4 differs from FIG. 2 in that an inclination angle detection unit 33 is provided. The inclination angle detection unit 33 detects the inclination angle of the hybrid shovel 1.

The slewing control unit 321 determines the reference time period so that the reference time period becomes longer as the inclination angle detected by the inclination angle detection unit 33 increases. In this case, the slewing control unit 321 only needs to determine the reference time period by using a reference time period determination table in which the inclination angle and the reference time period are associated with each other in advance.

Figure 5:
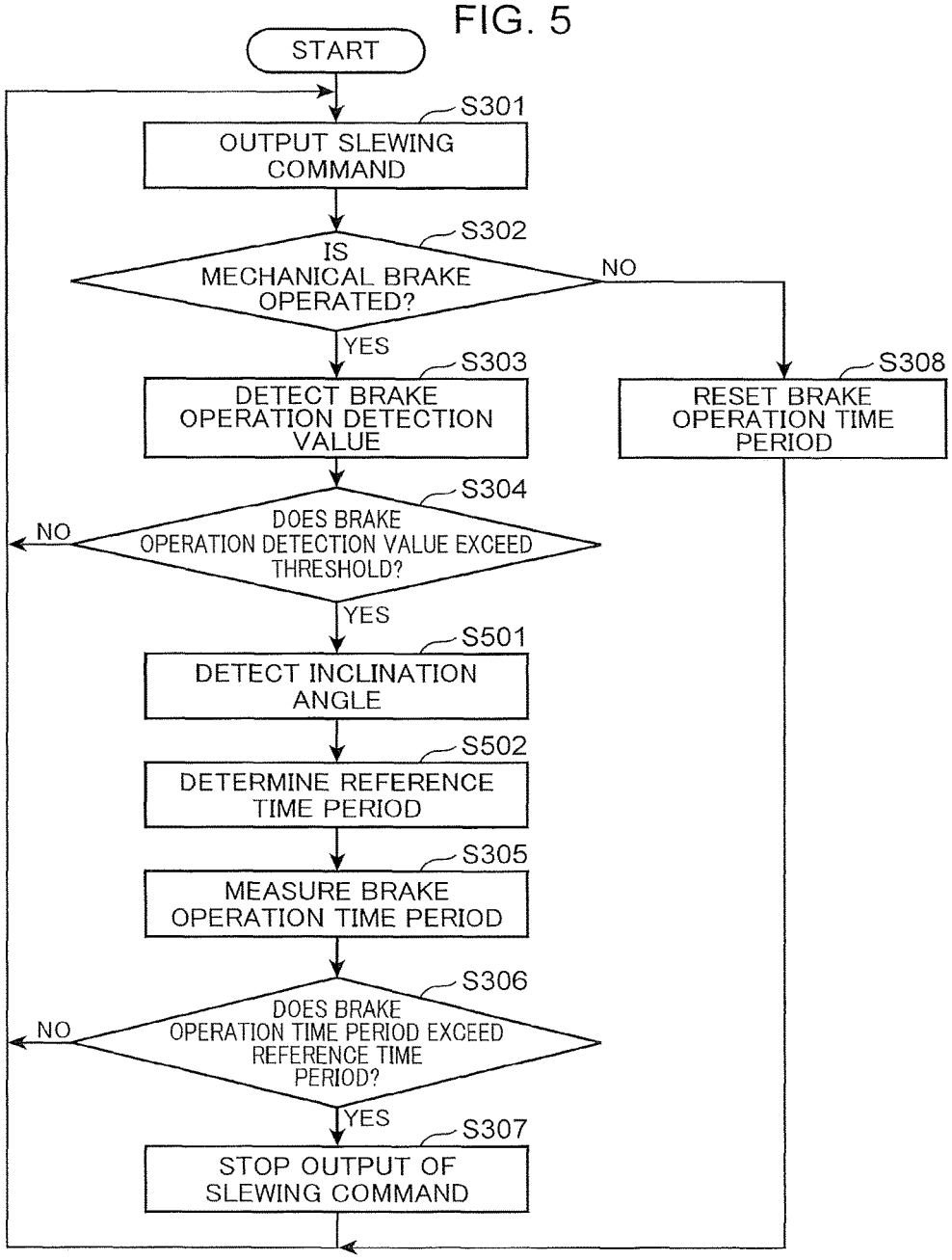
FIG. 5 is a flowchart illustrating operation of the hybrid shovel 1 according to Embodiment 2 of the present invention.

FIG. 5 is a flowchart illustrating the operation of the hybrid shovel 1 according to Embodiment 2 of the present invention. In FIG. 5, the same processing as that in FIG. 3 is denoted by the same reference symbol. In S501 following S304, the inclination angle detection unit 33 detects the inclination angle of the hybrid shovel 1.

In S502, the slewing control unit 321 determines a reference time period corresponding to the inclination angle detected by the inclination angle detection unit 33. After S502, the same processing as that in Embodiment 1 is continued.

On an inclined ground, the gravitational force acting in the direction of slewing the slewing superstructure 3 is larger than that on a flat ground. In Embodiment 2, the reference time period is determined based on the inclination angle. Consequently, the zero-speed control can be finished after waiting for the braking force of the mechanical brake 29 to be sufficiently effective, and hence the slewing-down movement can be prevented more reliably.

Embodiment 3

A hybrid shovel 1 in Embodiment 3 has a feature in that the reference time period is determined based on the temperature of the drive oil that operates the mechanical brake 29. In Embodiment 3, the same components as those in Embodiments 1 and 2 are denoted by the same reference symbols and descriptions thereof are omitted.

Figure 6:
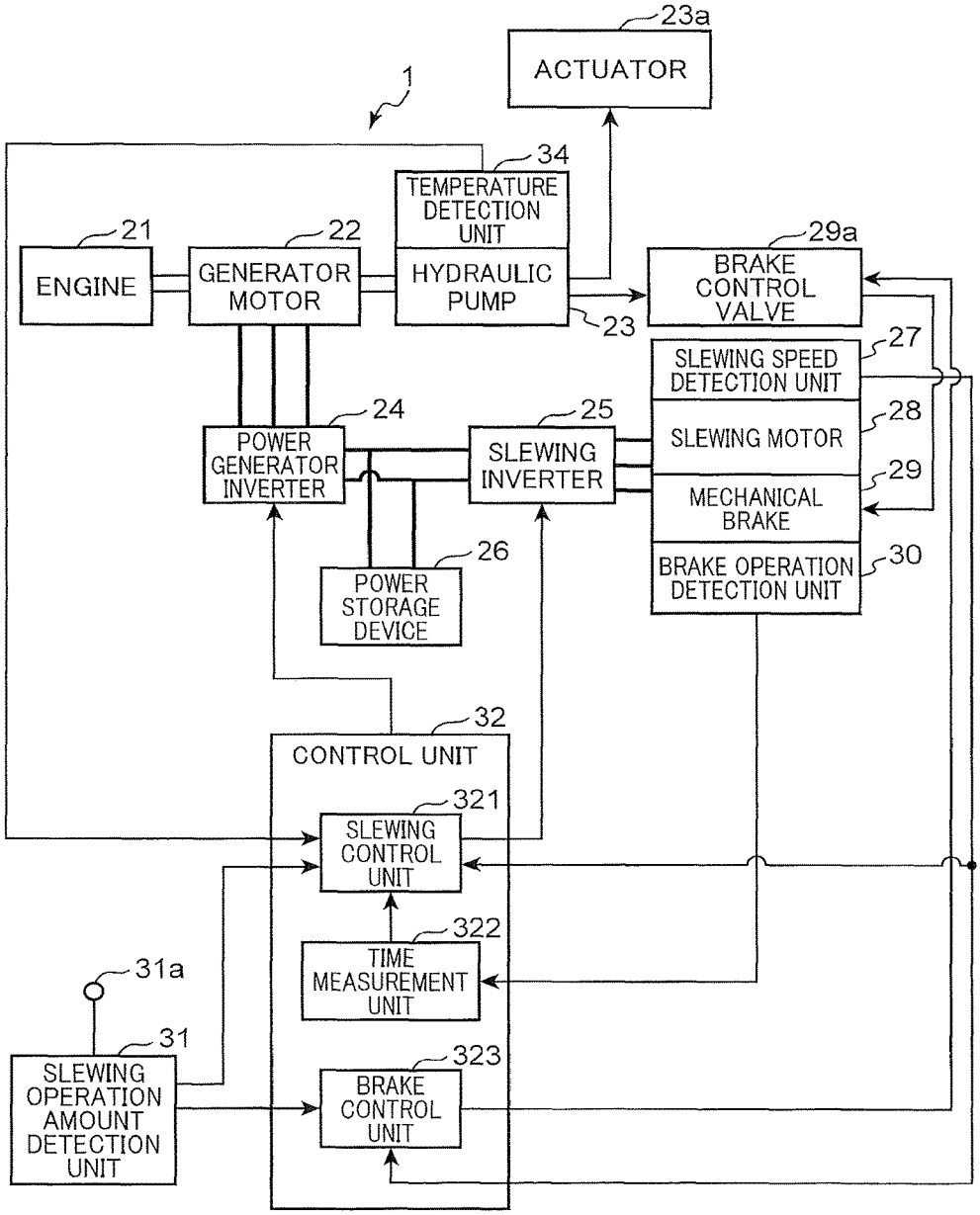
FIG. 6 is a block diagram illustrating an exemplary system configuration of a hybrid shovel 1 according to Embodiment 3 of the present invention.

FIG. 6 is a block diagram illustrating an exemplary system configuration of the hybrid shovel 1 according to Embodiment 3 of the present invention. FIG. 6 differs from FIG. 2 in that a temperature detection unit 34 is provided. The temperature detection unit 34 is, for example, a temperature sensor, and detects the temperature of the drive oil supplied from the hydraulic pump 23 to the mechanical brake 29.

The slewing control unit 321 determines the reference time period so that the reference time period becomes longer as the temperature of the drive oil detected by the temperature detection unit 34 decreases. In this case, the slewing control unit 321 only needs to determine the reference time period by using a reference time period determination table in which the temperature of the drive oil and the reference time period are associated with each other in advance.

Figure 7:
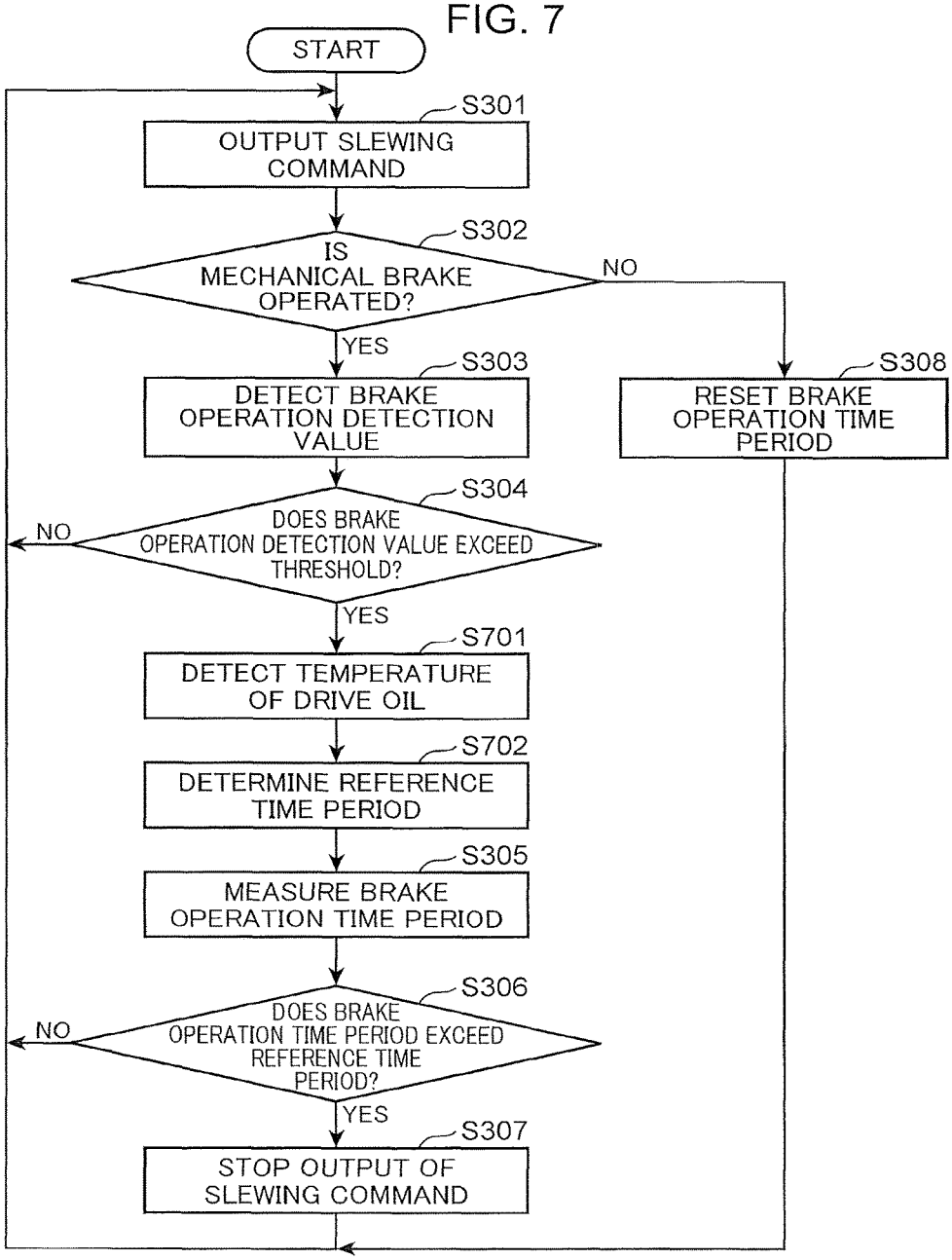
FIG. 7 is a flowchart illustrating operation of the hybrid shovel 1 according to Embodiment 3 of the present invention.

FIG. 7 is a flowchart illustrating the operation of the hybrid shovel 1 according to Embodiment 3 of the present invention. In FIG. 7, the same processing as that in FIG. 3 is denoted by the same reference symbol. In S701 following S304, the temperature detection unit 34 detects the temperature of the drive oil supplied from the hydraulic pump 23 to the mechanical brake 29.

In S702, the slewing control unit 321 determines a reference time period corresponding to the temperature of the drive oil detected by the temperature detection unit 34. After S702, the same processing as that in Embodiment 1 is continued.

The drive oil has a tendency that responsiveness becomes worse as the temperature becomes lower. In Embodiment 3, the reference time period is determined based on the temperature of the drive oil. Consequently, the zero-speed control can be finished after waiting for the braking force of the mechanical brake to be sufficiently effective, and hence the slewing-down movement can be prevented more reliably.

Summary of Embodiments

A slewing control device for a hybrid construction machine according to one aspect of the present invention includes:

a slewing motor configured to slew a slewing superstructure;

a slewing operation amount detection unit configured to detect a slewing operation amount of the slewing superstructure;

a slewing control unit configured to output a slewing command for operating the slewing superstructure at a slewing speed corresponding to the slewing operation amount, thereby controlling the slewing motor;

a slewing speed detection unit configured to detect a slewing speed of the slewing superstructure;

a mechanical brake configured to mechanically stop and hold the slewing superstructure;

a brake control unit configured to, when the slewing operation amount indicates slewing stop, avoid operating the mechanical brake until the detected slewing speed is equal to or lower than a predetermined speed, and operate the mechanical brake after the detected slewing speed is equal to or lower than the predetermined speed;

a brake operation detection unit configured to detect a brake operation detection value representing a braking force of the mechanical brake; and a time measurement unit configured to measure a time period during which the detected brake operation detection value exceeds a predetermined threshold, in which, when the mechanical brake is operated, the slewing control unit outputs the slewing command until the time period measured by the time measurement unit exceeds a predetermined reference time period, and stops outputting the slewing command after the measured time period exceeds the predetermined reference time period.

This configuration outputs the slewing command for operating the slewing superstructure at the slewing speed corresponding to the slewing operation amount. Therefore, when the slewing operation amount indicates slewing stop, zero-speed control for maintaining the slewing speed to be zero is started. Then, the mechanical brake is operated when the slewing speed becomes equal to or lower than a predetermined speed. When the time period during which the brake operation detection value indicating the braking force of the mechanical brake exceeds a threshold is continued for a predetermined reference time period or more, the output of the slewing command is stopped to stop the zero-speed control.

Consequently, this configuration enables the zero-speed control to be finished after it is confirmed that the braking force of the mechanical brake has been sufficiently effective, thereby preventing the slewing-down movement.

In addition, the zero-speed control is finished when it is confirmed that the braking force of the mechanical brake has been sufficiently effective, and hence power consumption for the zero-speed control can be reduced.

Further, the braking control device for a hybrid construction machine may further include:

a hydraulic pressure operation unit configured to operate the mechanical brake with a hydraulic pressure; and a hydraulic pressure detection unit configured to detect the hydraulic pressure, and the brake operation detection unit may detect the hydraulic pressure detected by the hydraulic pressure detection unit as the brake operation detection value.

In the case of controlling the mechanical brake with the hydraulic pressure, an operation delay occurs from when an instruction to operate the mechanical brake is issued to when the mechanical brake starts to be actually effective. In this aspect, the hydraulic pressure is detected as the brake operation detection value. Consequently, the slewing control unit can be controlled to stop outputting the slewing command in consideration of the operation delay, and hence the slewing-down movement can be prevented more reliably.

Further, the braking control device for a hybrid construction machine may further include an inclination angle detection unit configured to detect an inclination angle of the hybrid construction machine with respect to a horizontal plane, and the slewing control unit may determine the reference time period based on the detected inclination angle.

On an inclined ground, the gravitational force acting in the direction of slewing the slewing superstructure is larger than that on a flat ground. In this aspect, the reference time period is determined based on the inclination angle. Consequently, the zero-speed control can be finished after waiting for the braking force of the mechanical brake to be sufficiently effective, and hence the slewing-down movement can be prevented more reliably.

Further, the braking control device for a hybrid construction machine may further include:

a hydraulic pressure operation unit configured to operate the mechanical brake with a hydraulic pressure; and a temperature detection unit configured to measure a temperature of drive oil supplied from the hydraulic pressure operation unit to the mechanical brake, and the slewing control unit may determine the reference time period based on the detected temperature of the drive oil.

The drive oil has a tendency that responsiveness becomes worse as the temperature becomes lower. In this aspect, the reference time period is determined based on the temperature of the drive oil. Consequently, the zero-speed control can be finished after waiting for the braking force of the mechanical brake to be sufficiently effective, and hence the slewing-down movement can be prevented more reliably.

Further, a hybrid construction machine according to one aspect of the present invention includes: a slewing superstructure; and the braking control device for a hybrid construction machine.

This configuration can provide a hybrid construction machine capable of preventing slewing-down movement.

This application is based on Japanese Patent application No. 2015-196367 filed in Japan Patent Office on Oct. 2, 2015, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A slewing control device including a processor having circuitry, the slewing control device for a hybrid construction machine comprising:

a slewing motor configured to slew a slewing superstructure;

a slewing operation amount detection sensor configured to detect a slewing operation amount of the slewing superstructure;

a slewing control unit configured to output a slewing command for operating the slewing superstructure at a slewing speed corresponding to the slewing operation amount, thereby controlling the slewing motor;

a slewing speed detection sensor configured to detect a slewing speed of the slewing superstructure;

a mechanical brake configured to mechanically stop and hold the slewing superstructure;

a brake control unit implemented by the circuitry, the brake control unit configured to, when the slewing operation amount indicates slewing stop, avoid operating the mechanical brake until the detected slewing speed is equal to or lower than a predetermined speed, and operate the mechanical brake after the detected slewing speed is equal to or lower than the predetermined speed;

a brake operation detection sensor configured to detect a brake operation detection value representing a braking force of the mechanical brake; and a time measurement unit implemented by the circuitry, the time measurement unit configured to measure a time period during which the detected brake operation detection value exceeds a predetermined threshold, wherein, when the mechanical brake is operated, the slewing control unit outputs the slewing command until the time period measured by the time measurement unit exceeds a predetermined reference time period, and stops outputting the slewing command after the measured time period exceeds the predetermined reference time period.

2. The slewing control device for a hybrid construction machine according to claim 1, further comprising:

a hydraulic pressure operation valve configured to operate the mechanical brake with a hydraulic pressure; and a hydraulic pressure detection sensor configured to detect the hydraulic pressure, wherein the brake operation detection sensor detects the hydraulic pressure detected by the hydraulic pressure detection sensor as the brake operation detection value.

3. The slewing control device for a hybrid construction machine according to claim 1, further comprising an inclination angle detection sensor configured to detect an inclination angle of the hybrid construction machine with respect to a horizontal plane, wherein the slewing control unit determines the reference time period based on the detected inclination angle.

4. The slewing control device for a hybrid construction machine according to claim 1, further comprising:

a hydraulic pressure operation valve configured to operate the mechanical brake with a hydraulic pressure; and a temperature detection sensor configured to measure a temperature of drive oil supplied from the hydraulic pressure operation valve to the mechanical brake, wherein the slewing control unit determines the reference time period based on the detected temperature of the drive oil.

5. A hybrid construction machine, comprising:

a slewing superstructure; and the slewing control device for a hybrid construction machine according to claim 1.

* * * * *